US005860166A

United States Patent [19]

Ritts

[11] Patent Number: 5,860,166

[45] Date of Patent: Jan. 19, 1999

[54] EARMUFFS FOR USE WITH PROTECTIVE HEADGEAR

[76] Inventor: Graham Douglas Ritts, 411 Rustwood La., Duluth, Minn. 55804

[21] Appl. No.: 745,713

[22] Filed: Nov. 12, 1996

Related U.S. Application Data

[60] Provisional application No. 60/006,612 Nov. 13, 1995.

[51] Int. Cl. [6] ..... A61F 11/14

[52] U.S. Cl. ..... 2/209; 2/423; 128/866

[58] Field of Search ..... 2/209, 423; 128/866, 128/867

[56] References Cited

U.S. PATENT DOCUMENTS

| | | | |
|---|---|---|---|
| 3,477,067 | 11/1969 | Aileo | 2/209 |
| 3,943,572 | 3/1976 | Aileo | 2/423 |
| 4,669,129 | 6/1987 | Chance | 2/209 |
| 4,682,374 | 7/1987 | Geiser | 2/423 |
| 5,231,704 | 8/1993 | Hildenbrand | 2/243 |
| 5,426,790 | 6/1995 | Robertson | 2/209 |

*Primary Examiner*—Diana Biefeld
*Attorney, Agent, or Firm*—Dorsey & Whitney

[57] ABSTRACT

The present invention provides earmuffs for use with protective headgear, primarily helmets for use in contact sports such as hockey, football and the like, wherein the earmuffs are removably carried by the headgear in a position to protect the ears from cold, and do not interfere with wearing the helmet or the helmet wearer's activity.

5 Claims, 2 Drawing Sheets

EARMUFFS FOR USE WITH PROTECTIVE HEADGEAR

This application claims, under 35 U.S.C. 119(e), the benefit of U.S. Provisional Application No. 60/006,612, filed Nov. 13, 1995, now abandoned.

BACKGROUND OF THE INVENTION

1. Field of the Invention

The present invention relates generally to wearing apparel and, more specifically, to earmuffs for protecting a wearer's ears from cold, wherein the earmuffs are adapted to be worn with protective headgear such as helmets for use in sports.

2. Description of Related Art

People have long been active outside in cold weather. One of the portions of the human anatomy most susceptible to cold is the ears, and hats, hoods, scarves and other outerwear exhibit many adaptations for keeping the ears warm. Head bands designed expressly to cover the ears have been used, as have earmuffs. The latter usually comprise two discrete, disk-like bodies or pieces of material sized to cover the human ear. Typically, the two earmuffs are connected by a metal or plastic band which extends between the two muffs across the top of the head under tension to hold the muffs in place over the ears and to enable the adjustment of the earmuffs to fit different wearers.

One of the problems with many of the above-mentioned items for keeping the ears warm is that they can interfere with certain activities, particularly sports. Obviously, it would be difficult to play hockey or football while wearing a hood. In the past, people have played with cold ears or worn one of the types of items mentioned above, such as a stocking cap, head band or earmuffs, with the possibility of impaired performance due to interference with vision or movement of the article of apparel being worn to keep warm. If the possibility of impaired performance is acceptable, headbands, stocking caps and earmuffs generally work well for keeping warm while participating in wintertime sporting events such as hockey, skiing, ice skating and snowmobiling, at least when used without protective headgear.

However, another concern with respect to the cold weather activities mentioned above is safety. The cold weather activities mentioned above involve the possibility of head injuries from contact between players or equipment (in hockey or other sports), through contact with a hard surface such as ice (while playing hockey or ice skating) or from high speed collisions (while snowmobiling). Protective headgear goes a long way toward addressing safety concerns and has become almost mandatory in most, if not all, of the above sports. This is particularly true with reference to hockey played by young people, either in schools or youth leagues. Typically, protective headgear is intended to protect the head, skull and face, not keep the wearer warm.

It would be advantageous if protective and warming features could be combined, but the combination of protection headgear and warming articles of apparel causes problems. The protective headgear has to be modified or worn in larger than appropriate sizes to accommodate the warming apparel which, to be effective, should be worn inside or under the protective headgear. Helmets are specifically designed to fit the head very closely and, clearly, wearing a helmet that is the incorrect size, i.e., too large, diminishes the effectiveness of the protection provided thereby. Vision may be blocked if the helmet shifts and the helmet could come off entirely. Attempting to wear an article of apparel such as a stocking cap or earmuffs on the outside of a helmet is ineffective. The article will likely slip off the helmet. Wearing articles on the outside of a helmet will not be very effective because the article will be spaced from the head and ear.

It would be advantageous if there were a way to keep the ears warm effectively and safely while wearing protective headgear, such as a hockey helmet, without interfering with the activity being undertaken or the effectiveness of the protection gained by wearing the headgear.

SUMMARY OF THE INVENTION

The present invention provides earmuffs for use with protective headgear, primarily helmets for use in contact sports such as hockey, football and the like, wherein the earmuffs are removably carried by the headgear in a position to protect the ears from cold, and do not interfere with wearing the helmet or the helmet wearer's activity.

More particularly, each of a pair of earmuffs for use with protective headgear comprises a body having a periphery and a center, said body formed by a core having two sides and a peripheral edge generally aligned with said periphery and an exterior layer covering a side of the core and the periphery, and attachment means for attaching the earmuff to the protective headgear, said attachment means carried on the other side of the core and generally at the center of the body.

It is an object of the present invention to provide earmuffs for use with protective helmets for sports, particularly hockey helmets, wherein the earmuffs may be removably carried by commercially available helmets.

Another object of the present invention is to provide a warming article of apparel, namely earmuffs, which may be worn safely and effectively with protective helmets, particularly hockey helmets with ear protection features.

An advantage of the earmuffs of the present invention is that they may be easily attached to and removed from a helmet for washing or for transfer to another helmet. Another advantage is that they may be used without changing the helmet size appropriate for the person using them, and without diminishing the scope of protection the helmet is intended to provide.

Other objects, features and advantages of the present invention will become more fully apparent and understood with reference to the following description and to the appended drawings and claims.

DETAILED DESCRIPTION OF THE PREFERRED EMBODIMENT

Components and features of this invention may be connected, joined or attached by appropriate fasteners and fastening methods such as sewing, stitching, adhesives, weaving, "hook and loop" type materials and the like, as well as other conventional fastening devices and methods. The hockey helmet depicted and described herein is intended to be representative of all types of hockey helmets, as well as other headgear such as army helmets, motorcycle helmets, "hardhats," sports (e.g., football, baseball, bicycling, etc.) helmets and the like. Generally, unless specifically otherwise disclosed or taught, the materials for forming the present invention may be selected from appropriate materials or mixtures of materials including various natural or synthetic materials (wool, cotton, nylon, other polymers or the like), as long as the selected material has sufficient insulating, softness and compressibility properties. The type of material, the thickness, exterior or interior texture or profile patterns and color of the ear muff can be selected as desired, as can the size thereof. Any references to front and rear, top and bottom or similar positional terms are used merely for convenience of description.

Figure 3:
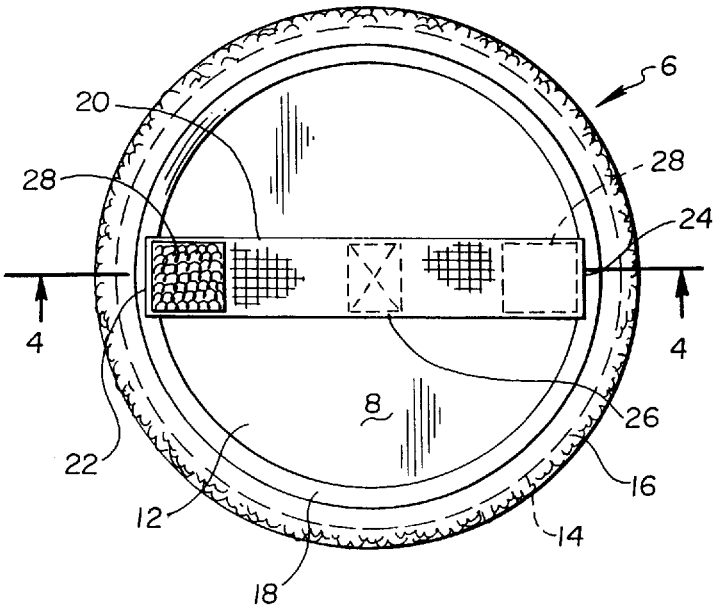
FIG. 3 is an elevation view of the outside of one of the earmuffs of the present invention.
Figure 4:
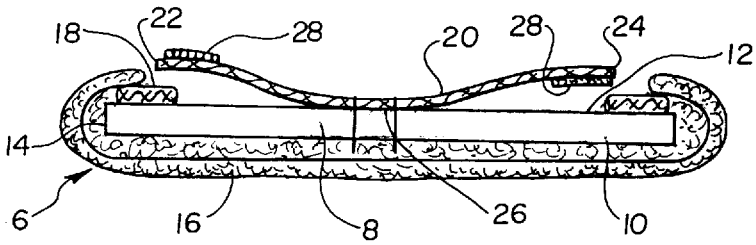
FIG. 4 is a sectional view taken along the line 4—4 of FIG. 3.

Referring to the Figs., particularly FIGS. 3 and 4, an earmuff 6 in accordance with the present invention is depicted. The earmuff 6 is one of a pair of such earmuffs, wherein each is substantially identical, so only one earmuff 6 will be described herein. The earmuff 6 has a lightweight, generally solid body formed by a central core 8 having a first side 10, second side 12 and a generally circular peripheral edge 14. The core 8, and consequently, the body are shaped like a disk or flattened cylinder. One side 10 and the edge 14 are continuously covered by a material layer 16. The covered side 10 is the ear contacting side when in use. The material layer has an annular elasticized portion 18, and fits generally closely and tightly with the side 10 and edge 14.

The opposite side 12 of the core 8 (the side facing outwardly, away from a user's ear when in use) carries a generally exposed attachment strap 20. The strap 20 has a continuous length and two free ends 22, 24. It is stitched to or otherwise appropriately attached to the core 8 at about the midway point 26 along the length. Each end 22, 24 carries one portion (both shown at 28) of complementary connection means by which the two ends may be securely yet releasably connected together to form a continuous loop. In the preferred embodiment, a hook and loop interactive fabric such as a Velcro-like material comprises the connection means, but other connective methods may be used including snap-type connectors, buckles or single hook/loop connectors.

Figure 1:
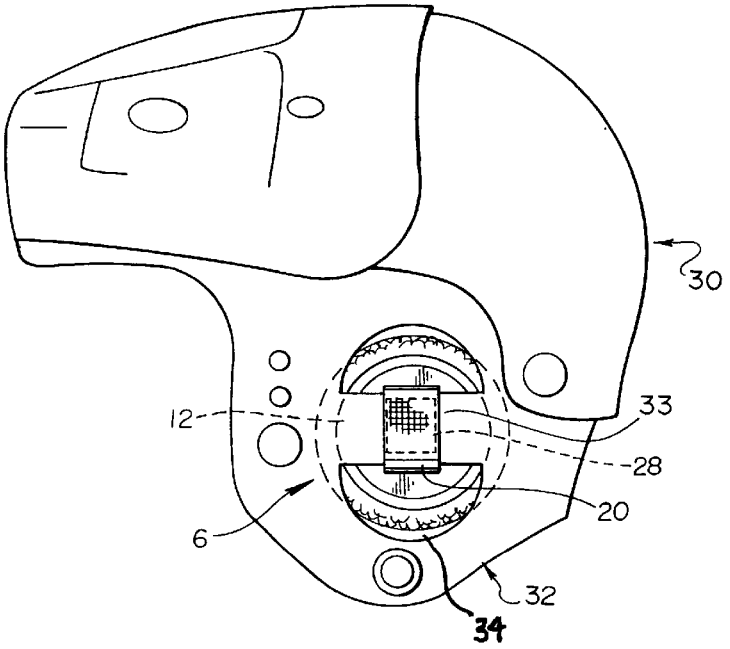
FIGS. 1 and 2 depict hockey helmets with the earmuffs of the present invention (only one is visible) in place, ready for use.
Figure 2:
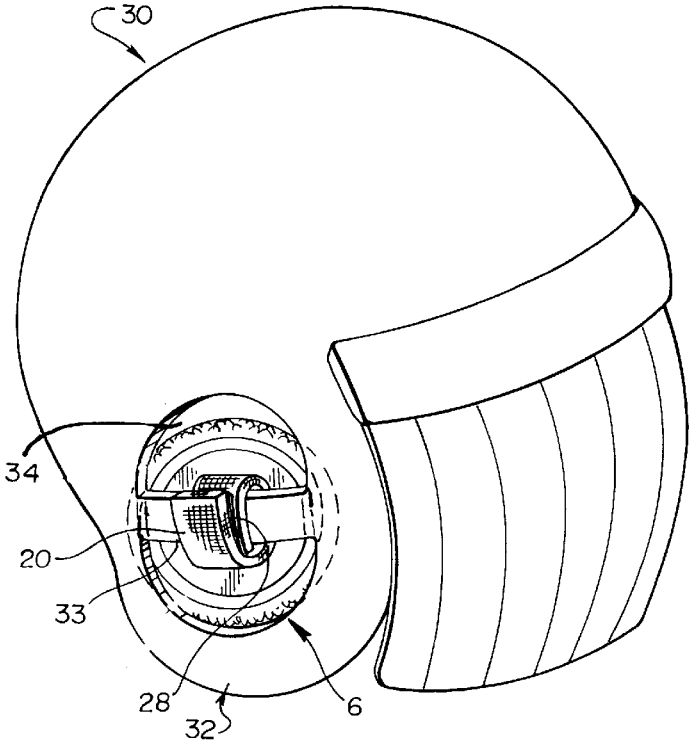

The earmuffs of the present invention are depicted ready for use in FIGS. 1 and 2. A typical hockey helmet 30, intended to be representative of many types of protective headgear, particularly the most recently commercially available helmets for young people, includes an ear protective structure or region, indicated generally at 32, for protecting the wearer's ear. The protective structure 32 may be an integral portion 33 of the helmet 30 extending across the ear opening 34, as shown in FIG. 1, or it may be a detachable grid mounted in and extending across the ear opening 34. Although the depicted protective structures 32 extend horizontally across the ear opening 34, other ear protectors may include horizontal and/or vertical, straight or curved members or bars across the ear opening 34.

In use, a pair of the earmuffs of the present invention are positioned inside the hockey helmet, one on each side, generally in the ear receiving area inside the protective structure 32. The ends 22, 24 of the strap 20 are disconnected and threaded through the customary openings found at the ear protective structure 32. The strap 20 is tightened, and the ends are reconnected to each other, thereby holding the ear muff(s) tightly in place against the inside wall of the helmet, particularly the ear protecting structure thereof. The helmet is then placed on the user's head and worn as usual.

While hockey helmets 30 are depicted, and the earmuffs of the present invention are particularly intended for use with hockey helmets, even more particularly for those helmets which have ear protection features, the earmuffs 6 of the present invention may be used with football helmets, bicycle helmets, as well as the type of helmets which might be used by ice skaters and speed skaters. Further, by providing a Velcro-type hook or loop fabric patch inside and connected to the helmet in the region of a wearer's ear, and a complementary fabric carried by or on the outside, helmet-facing surface of the earmuffs, they can be adapted for use with helmets used by snowmobilers or motorcyclists. The structure of the earmuffs 6 of the present invention may be varied as well. For example, instead of a two-part body comprising a core 8 and a layer of material 16 wrapped partially or completely around the core, the earmuff 6 may be a unitary body formed of a single appropriate insulating material. If an exterior layer of material 16 is used, instead of using an elasticized band 18 to hold it in place, it may be secured in place about a core or filling by means such as sewing, adhesives or snaps.

Although the preferred embodiment of the earmuffs 6 of the present invention described herein above uses a Polarfleece® layer or shell of material 16 around a Thinsulate™ core 8, any appropriate material may be used for both the core 8 and wrapping material 16. While the preferred earmuff 6 is approximately ½ inch thick and 3 inches in diameter, it may be made available in a range of sizes. Although a single attachment strap 20 is depicted, more than one such strap may be used in more than one orientation with respect to a helmet, i.e, vertically, horizontally or angled, as long as the helmet to earmuff connection is secure. Attachment straps of various lengths may be used, and, as stated above, the connective means for securing the strap ends together about a section of a helmet may be Velcro®, snaps or buckles or other suitable connective means. For example, the attachment means may take the form of a patch of complimentary material adhered to the inside of a helmet, and a complimentary piece of material carried or provided on or by the outside surface of the earmuff.

The earmuff, either the shell of material 16 or the core 8, could be entirely or partially textured on the inside and/or the outside surface thereof. Each earmuff could have two or more of the band-like strap member 20.

Although a description of the preferred embodiment has been presented, various changes including those mentioned above could be made without deviating from the spirit of the present invention. It is desired, therefore, that reference be made to the appended claims rather than to the foregoing description to indicate the scope of the invention.

What is claimed is:

1. A pair of substantially similar earmuffs for use with a hockey helmet, each comprising:

a body comprising:

a central core having a first side, a second side and a generally circular peripheral edge; and a layer of material overlying at least one of the first and second sides and the edge, said layer having an elasticized portion and fitting generally closely and tightly with said at least one of the first and second sides and edge; and an attachment strap carried by at least one of the first and second sides, said strap having a length and two ends, and attached to the core adjacent to a midpoint of the length, whereby the two ends may be releasably connected together to form a substantially continuous loop for connecting the body to the helmet.

2. The earmuffs according to claim 1, wherein each of the ends carries one portion of complementary connection means by which the two ends may be securely yet releasably connected together to form a continuous loop.

3. The earmuffs according to claim 2, wherein the connection means is a hook and loop interactive fabric.

4. An ear protector intended to be used as a substantially identical pair of such ear protectors adapted for use with protective headgear, each said ear protector comprising:

a central core having a two sides and a peripheral edge, each of said sides having a generally central region;

an exterior layer substantially covering one of said sides and the peripheral edge, said exterior layer having an elasticized portion and fitting generally closely and tightly with the substantially covered one of the sides and peripheral edge; and a fastener for attaching the ear protector to the protective headgear, said fastener carried on the side of the core not substantially covered by the exterior layer for directly attaching the core and the protective headgear.

5. The ear protector according to claim 4, wherein the fastener is carried in the generally central region.

* * * * *